United States Patent [19]

Gianfranco

[11] Patent Number: 5,076,018

[45] Date of Patent: Dec. 31, 1991

[54] DEVICE FOR EASILY ASSEMBLING AND DISASSEMBLING SLIDABLE DOORS TO AND FROM PIECES OF FURNITURE

[75] Inventor: Cinetto Gianfranco, Padova, Italy

[73] Assignee: Cinetto F.LLI S.r.l., Rubano, Italy

[21] Appl. No.: 542,046

[22] Filed: Jun. 22, 1990

[51] Int. Cl.[5] ..... E05D 13/00

[52] U.S. Cl. ..... 49/410; 49/425

[58] Field of Search ..... 49/410, 411, 425, 426

[56] References Cited

U.S. PATENT DOCUMENTS

| | | | |
|---|---|---|---|
| 2,791,006 | 5/1957 | Eichler | 49/411 |
| 3,138,830 | 6/1964 | Scharge | 49/425 X |
| 3,166,801 | 1/1965 | Provenzo | 49/410 X |
| 3,701,179 | 10/1972 | Cox | 49/411 X |
| 4,176,497 | 12/1979 | Nagy | 49/411 |
| 4,353,186 | 10/1982 | Offterdinger | 49/425 X |
| 4,486,980 | 12/1984 | O'Bar | 49/411 X |
| 4,651,469 | 3/1987 | Ngian et al. | 49/411 X |
| 4,769,949 | 9/1988 | Glendowne | 49/410 |
| 4,873,741 | 10/1989 | Riegelman | 49/425 X |

FOREIGN PATENT DOCUMENTS

| | | | |
|---|---|---|---|
| 1515116 | 1/1968 | France | 49/411 |
| 1082771 | 9/1967 | United Kingdom | 49/425 |
| 1124740 | 8/1968 | United Kingdom | 49/425 |

*Primary Examiner*—Rodney M. Lindsey
*Assistant Examiner*—Jerry Redman
*Attorney, Agent, or Firm*—Berman & Aisenberg

[57] ABSTRACT

The device (D) for easily assembling and disassembling slidable doors (A1, A2) to and from a piece of furniture (M), comprises a body (5) fitted with a door-sliding wheel (7), which is associated with the lower side of a horizontally slidable door (A1, A2), by being connected thereto through a clamp member (1), which is secured to the projecting free end of a door-supporting member (S3, S4), which in turn is fastened to the lower side of the respective door (A2, A2). The said body (5) is swingable about pivot (4) extending parallel to the door lower side, so that by being caused to swing upwardly, this body is angularly moved from a horizontal rest position to an upright operative position, and the same is thus preferably automatically inserted into the respective door-guiding, channel-shaped rail (B3, B4), as a result of parts of the said body (5) being caused to cooperate with the respective rail (B3, B4), or with lower stationary parts of a piece of furniture (M).

6 Claims, 2 Drawing Sheets

DEVICE FOR EASILY ASSEMBLING AND DISASSEMBLING SLIDABLE DOORS TO AND FROM PIECES OF FURNITURE

FIELD OF THE INVENTION

The invention relates to a device for easily assembling and disassembling slidable doors to and from pieces of furniture, which is meant for being applied to the lower side of horizontally slidable doors, in order to simplify the door assembly and disassembly to and from the respective door-guiding rails, whenever this work needs to be done from one side of the rails, and which may be used for other purposes.

SUMMARY OF THE INVENTION

According to the invention, this object is attained by fitting the door-sliding wheel, or a door-sliding shoe, to be associated with the lower side of a slidable door, on a swingable body that when a slidable door is being assembled to a piece of furniture, initially lies in a horizontal rest position substantially at right angles with the slidable door, and that while this door is being turned about the respective upper rail, so as to have its lower side drawn close to the respective, channel-shaped lower rail, is caused to cooperate either directly, or through inserted parts, with one side of this latter rail or with other stationary parts, whereby the said swingable body fitted with a door-sliding wheel or shoe, is caused to swing upwardly, is correctly inserted into the said channel-shaped lower rail, and is brought into an end-of-stroke upward position, in which the said swingable body is stably held, owing to its direct or indirect cooperation with retaining, snapping or friction means. When the slidable door has to be disassembled, the lower side of the door needs only to be pulled away from the respective, channel-shaped lower rail. The swingable body fitted with the door-sliding wheel or shoe, is then caused to swing downwardly, and is caused to get out of the respective, channel-shaped lower rail, so that it is sufficient to lift the door for having the same released from the respective upper rail, and disassembled from the piece of furniture to which this door was assembled.

BRIEF DESCRIPTION OF THE DRAWINGS

Further features of the invention, and the advantages arising therefrom, will more clearly appear in the following specification of one preferred embodiment of the invention, which is shown merely by way of a non-limiting example in the Figures of the annexed sheet of drawing, in which.

DETAILED DESCRIPTION OF THE PREFERRED EMBODIMENT

Figure 2:
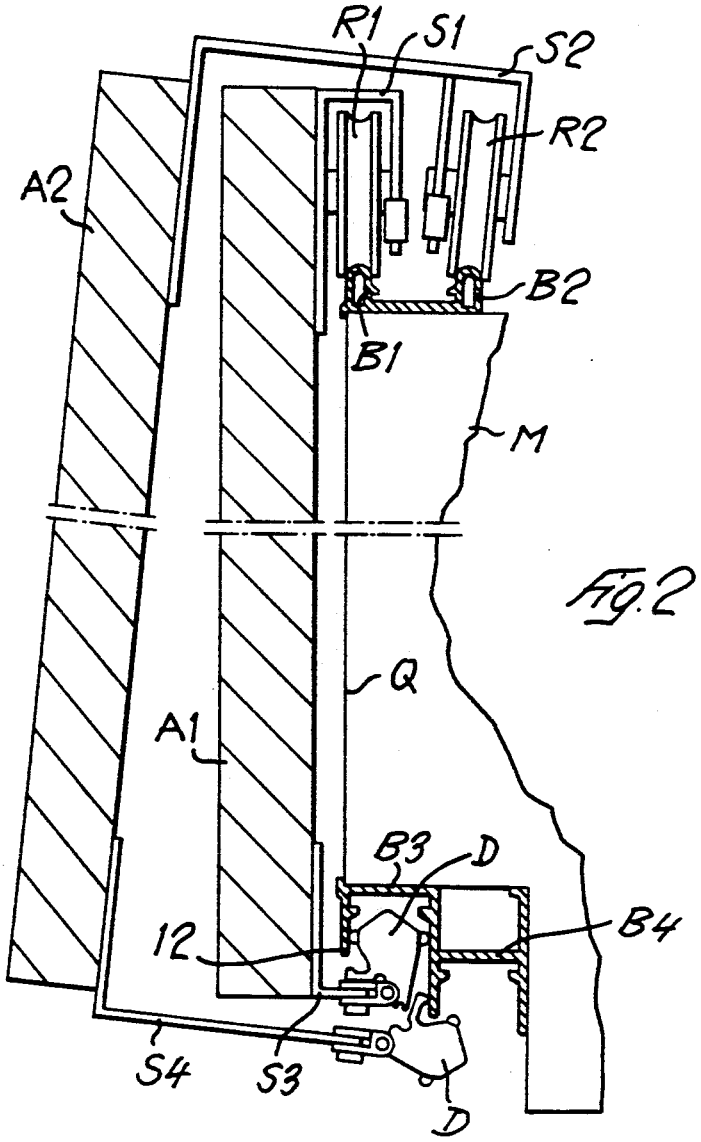
FIG. 2 is a part-sectional side view of two slidable doors for a piece of furniture, which are both fitted with a device according to the invention, and are respectively shown in assembled condition, and in an intermediate step of assembling a slidable door.

In FIG. 2, references A1 and A2 denote two horizontally slidable doors respectively fitted, or in the course of being fitted on a piece of furniture M, which in the upper portion of their inward face are respectively provided with door sliding and guiding means of any suitable known type, such as pairs of grooved wheels R1, R2, carried by the door-supporting members S1, S2, and which are slidable on respective upper rails B1, B2 secured to the horizontal upper side of a piece of furniture M forepart having an opening Q.

By means of the door-supporting members S3, S4, the door-sliding devices D, according to the invention, are mounted on the lower side of the slidable doors A1, A2, and are caused to cooperate with respective, channel-shaped lower rails B3, B4 secured to the horizontal lower side of the said piece of furniture M forepart having an opening Q. To be enabled to use the said devices D, the lower rails B3, B4 need to be located at different levels, so that according to the substantially known illustrative arrangement shown in FIG. 2, the rail B4 for the door A2 should lie at a lower level than the rail B3 for the door A1. One or more door-supporting members S3, S4, supporting in turn the respective devices D, may of course be provided on each slidable door A1, A2.

Since a same device D is associated with each door A1, A2, only the device D associated with the door A1 will be disclosed hereinafter.

Figure 1:
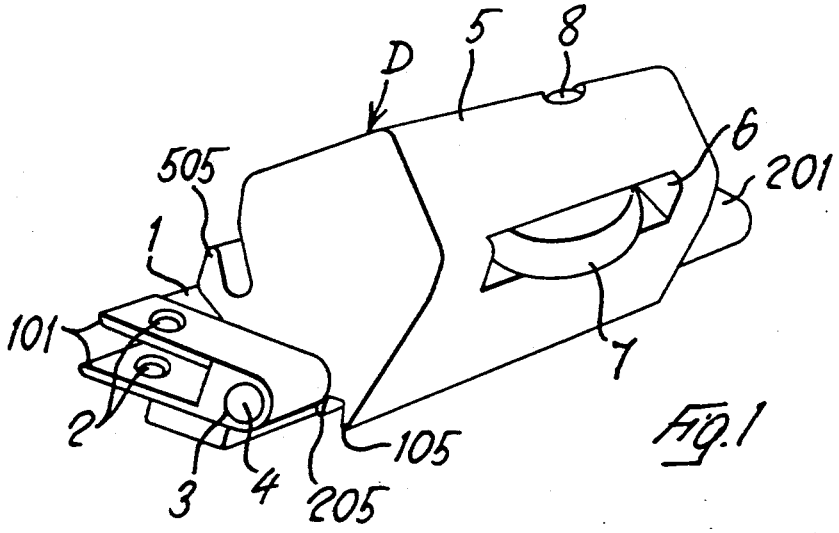
FIG. 1 is an elevational view of the devie according to the invention, shown in its operative condition.
Figure 3:
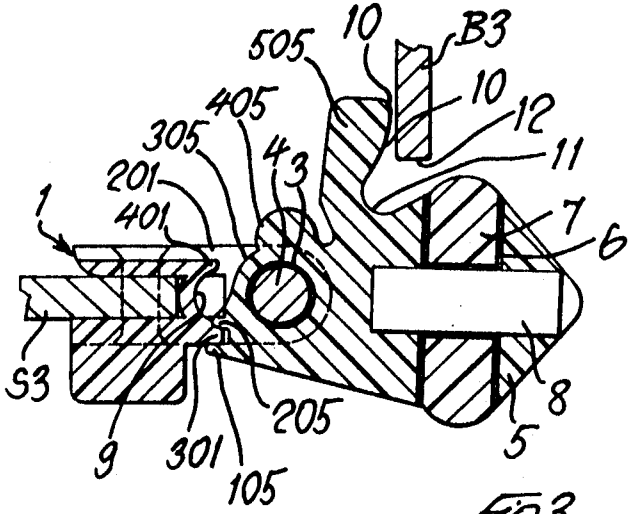

Referring also to FIGS. 1 and 3, there appears that the device D comprises a clamp member 1 made preferably of loaded nylon, or of any other suitable material, and having a "C" profile, such that the free end of the door-supporting member S3 can be clamped between the arms of the clamp member 1, and can be secured thereto by means of screws, rivets, or any like suitable means, threaded through a pair of bores 2 in the free ends 101 of the said clamp member arms. At the end of the side edges of the clamp member arms, which are opposite to the free ends 101 thereof, the clamp member 1 is integrally formed with a pair of respective, parallel, equal lugs 201 extending away from the door-supporting member S3, and giving the clamp member a substantially "U"-like configuration. The lugs 201 are provided with through bores 3 preferably of a same diameter, which are in-line with each other on a common axis, that is parallel to the planes in which lie the arms of the clamp member 1, and to the rails B3, B4, and a steel pivot 4 with a round cross-section, is pressure-fitted by its ends into these bores.

Prior to pivot 4 being fitted into the said bores 3, a body 5 also made preferably of loaded nylon, or of any other suitable material, is fitted between the lugs 101, 201 by its one end provided with a bore having a slightly greater diameter than the bores 3, and which can be set in line therewith, whereby the pivot 4 is threaded through body 5 which, when required, may be caused to freely swing about the said pivot.

The said swingable body 5 is substantially prismatic in shape, with a substantially drop-like profile in cross-section and, more particularly, it is fulcrumed about pivot 4 by the bored end portion of its tapered narrow side. The said body 5 gradually flares out in the direction away from pivot 4. The wide portion of the swingable body 5 is intermediately formed with a transversal slot 6, in which a door-sliding wheel 7, preferably of a suitable plastics material, is rotatably fitted, and is held in position by a pivot 8 pressure-fitted into a respective recess formed in the said body 5. The wheel 7 has a rounded peripheral surface, and projects from either sides of said slot 6 by an equal amount of its periphery. The end portion of body 5 which lies over the wheel 7, has an isosceles triangular profile, with its apex being suitably beveled for the purposes to be disclosed hereinafter.

Figure 4:
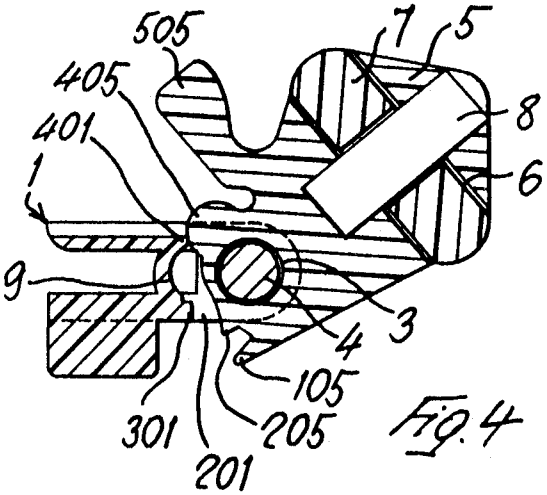
FIGS. 3, 4 and 5 are cross-sectional view of the said device, respectively showing this device in its horizontal rest position, in a position according to an intermediate step of assembling or disassembling a slidable door fitted with this device, and in its upright operative position, once the slidable door has been assembled.
Figure 5:
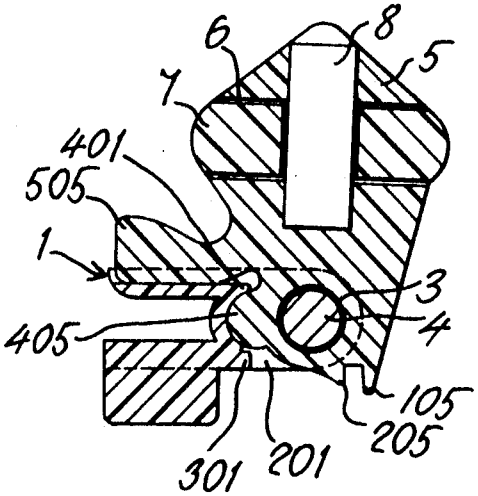

When the device D according to the invention, is in rest position, as in FIG. 3, its swingable body 5 is so positioned that the axis of pivot 8 substantially lies in the ideal plane containing the clamp member 1, and the said body 5 is stably held in this position by a member 105 having a tooth-like profile in cross-section, which extends along the side edge of the tapering right-hand side thereof, as seen in FIGS. 4 and 5, and is caused to abut against the underside of the clamp member (1) lower arm. The swingable body 5 is also provided on its tapered narrow side with a further member 205 having a tooth-like profile in cross-section, which is suitably spaced apart from the tooth-like profiled member 105, and extends in parallel relation therewith, and which is caused to bear on a rib 301 provided on the rear end of the clamp member 1 lower arm, and comes to be clamped between the said tooth-like profiled members 105 and 205. The members 105, 205, and 301 are preferably so provided as to extend throughout their length along the side edge of the tapering right-hand side and the tapered narrow side of body 5, and across the clamp member 1, respectively, but it is understood that the said members may be differently sized. The swingable body 5 is thus stably held in its horizontal rest position.

The cooperation between the said members 105, 205, and 301 in the swingable body 5 and in the clamp member 1, respectively, is however such that with the clamp member 1 being kept stationary, and by applying an even weak force to the said body 5, so as to cause the same to swing upwardly, the tooth-like profiled member 205 will frictionally override the rib 301, so that the swingable body 5 is allowed to quite freely continue its upward swinging movement, through which it is led. Whereas, when the said body 5 is caused to swing downwnardly, the tooth-like profiled member 205 will again override the rib 301, and the tooth-like profiled member 105 will be moved into abutment with the underside of the clamp member 1 lower arm, so that the device D is again stably held in its rest position. This latter condition is signalled by a click.

Still in FIG. 3 there appears that the upper arm of the clamp member 1 is provided at its rear end with a further, suitably profiled rib 401 which is parallel to the rib 301 on the rear end of the clamp member 1 lower arm, and between the said ribs 401, 301 a recessed portion 9 is provided, having, for example, an arcuate profile, or any other suitable profile.

The swingable body 5 is provided on that portion of its tapered narrow side which is adjacent to pivot 4 about which this body is fulcrumed, with an arcuately profiled section 305 which does not interfere with any part of the clamp member 1, and at the end of its tapering left-hand side, as seen in FIGS. 3, 4 and 5, is formed with a rib 405 extending parallel to pivot 4, and having a suitably convex profile, for the purposes to be disclosed hereinafter.

Formed of one piece with the swingable body 5 is a member 505 having a wing-like profile in cross-section, with its right-hand side 10, as seen in FIGS. 3, 4, 5, being suitably beleveled, and which extends from the tapering left-hand side of body 5. The said beveled side 10 of the wing-like profiled member 505 is linked to body 5 by a connecting section 11, and lies in a properly spaced apart, substantially parallel relation with the said rib 405. With the swingable body 5 being in its horizontal rest position, as in FIG. 3, the said wing-like profiled member 505 is directed upwardly. Thanks to the provision of the said connecting section 11, the swingable body 5 of the device D for the door A1 can be easily fitted into the respective door-guiding, channel-shaped rail B3, as disclosed hereinafter.

By subjecting the body 5 to an upward swinging movement, according to the succession of steps shown in FIGS. 4 and 5, the rib 405 in body 5 is at first caused to frictionally pass over the rib 401 on the rear end of the clamp member 1 upper arm. The said rib 405 is then caused to cooperate with the recessed portion 9, and is pushed downward, into abutment therewith (FIG. 5), thanks to the particular profiles of the said ribs 405, 401 and the said recessed portion 9 being caused to cooperate with each other, when the side of the wing-like profiled member 505, which is opposite to its beveled side 10, comes to bear against the upper arm of the clamp member 1, whereby the body 5 is firmly held in its upright operative position, in which the pivot 8 for the wheel 7 is directed vertically.

The swingable body 5 of the device D according to the invention, is slidably connected to the channel-shaped rail B3, as follows.

Referring to FIG. 2, there is shown that the body 5 of the device D, is so sized, so located and oriented relative to the channel shaped lower rails B3, B4 (see FIG. 3), that when the door A1 has been hung by its upper wheels R1 from the respective upper rail B1, and the lower side of door A1 is being drawn close to, and pushed against the lower rail B3, the beveled side 10 of the wing-like profiled member 505 is caused to bear on the outward face of the external side of the channel-shaped rail B3, which has its free end preferably formed with a rounded edge 12, in order to avoid any undesired friction and stresses, when the said rail B3 is caused to cooperate with the said body 5. As a result of the beveled side 10 of the wing-like profiled member 505 being thus caused to cooperate with the rail B3, the body 5 is swung upwardly, as disclosed above by referring to FIGS. 3, 4, and 5. As previously disclosed by referring to the succession of steps shown in FIGS. 4 and 5, the upward swinging movement of body 5 will be concluded, and this body will be stably held in its upright operative position, thanks to the cooperation of the said body 5 and the wheel 7 protruding therefrom, with the inward face of the internal side of the channel-shaped rail B3, which is opposite to the external side of this rail, with which the wing-like profiled member 505 has been initially caused to cooperate. When the body 5 stands in its upright position as in FIG. 5, the wheel 7 is slidably received in the rail B3, so that the door A1 will be held in the proper position relative to the opening Q of the piece of furniture M to which it is now assembled.

It is apparent that the assembly of a slidable door A1, A2 on the respective piece of furniture M is thus considerably simplified, and is quickly practicable even by unskilled persons. At any time, the door A1, A2 can be disassembled from the respective piece of furniture M just as simply and quickly as it has been assembled thereto, by pulling its lower side away from the respective lower rail B3, B4, and by lifting this door so as to disengage the same from the respective upper rail R1, R2.

Of course, numerous changes and modifications may be brought to the disclosed device according to the invention, the more so in construction.

Thus, for example, the wheel 7 may not be provided, and the body 5 may be used as a sliding shoe. The use may be contemplated of rolling means different from the wheel 7 and being otherwise arranged. Instead of wheel 7, a roller may be, for example, used, which is fitted in a cantilevered manner on the swingable body 5, and is formed with one conical, or suitably rounded end, for its cooperation with the internal side of the rail B3, B4, the said roller being provided in place of the said body 5 end portion having a triangular profile.

The body 5 may be, for example, stably held in its rest and in its operative position, respectively shown in FIG. 3 and 5, by the provision of means other than the described means, such as a pin or an elastically loaded ball accomodated in body 5 (or in the clamp member 1, 201), which is caused to snappingly cooperate with recesses formed in the clamp member 1, 201, or in pivot 4, provided that this pivot be rotatively locked (or in body 5). According to a further modified embodiment, the body 5 may be stably held at least in its angular operative position, by parts of its wing-like profiled member 505 being caused to snappingly cooperate with mating parts of the clamp member 1.

According to yet another modified embodiment, the upward swinging movement of body 5 may be also initially promoted by suitably shaped parts of the said body being caused to cooperate with the internal side of the rail B3 or B4 that guides the respective device D, and the said side may be suitably shaped, so as to be caused to perform the function of a cam.

According to still a further modified embodiment, the body 5 may be urged upwardly by an elastic means, and may be held in the position shown in FIG. 3, by a bolt member being, for example, longitudinally slidably fitted on the door-supporting member S3, and extending across the clamp member 1, and which is caused to cooperate with recessed or projecting parts in that portion of body 5 which is adjacent to pivot 4, about which this body is fulcrumed. Otherwise, the bolt member may be incorporated in body 5, and may be connected to a trigger-like member, which by being moved into abutment with parts of a piece of furniture or of the lower rail B3 or B4, at the time a door A1 or A2 is being assembled, is so triggered as to release the swingable body 5, that will automatically get into this rail, without any particular pushing action on the to-be-assembled door A1 or A2 being required.

In the said modified embodiments, the swingable body 5 may be held in its upright operative position shown in FIG. 5, only by the action of spring means, and/or also by the action of frictionally or snappingly operating locking means.

According to yet a further modified embodiment, instead of being caused to swing around a real axis, that is, around the axis of pivot 4 shown in the drawings, the swingable body 5 may be caused to swing around a virtual axis which can be obtained, for example, by the members 5, 1 being connected to each other by means of small cradles or suitable levers.

I claim:

1. A device for removable connection of a side of a slidable door to a door-guiding rail comprising a body (5) having a sliding means for slidably engaging an interior portion of said rail and holding in position said side of said door (A1, A2), means for pivotally mounting said body to said door for rotation of said body around an axis which is parallel to the side of said door (A1, A2), first means for holding said body (5) in an orientation extending away from said side of said door (A1, A2), said body comprising means for engaging said rail (B3, B4) and rotating said body from said orientation extending away from said door into an operative position wherein said sliding means engages said interior portion of said rail as said door is moved toward said body, and second means for holding said body (5) in said operative position and for allowing said body to be rotated to an orientation extending away from said door when said door (A1 or A2) is to be disassembled from said rail (B3 or B4).

2. A device according to claim 1, wherein said means for pivotally mounting comprises a clamp member (1) for connection to a projecting free end of a door-supporting member (S3, S4) fastened to a lower inner portion of a slidable door (A1, A2), said body (5) having a substantially drop-like profile in cross-section, which gradually flares out in the direction away from said axis and forming a portion with inclined equal sides, and with its apex being beveled, and a slot (6) for rotatably receiving a wheel (7) having a rounded peripheral surface, which extends from both sides of the said slot (8), and a member (105) on a side edge of said body (5) for engaging the underside of said clamp member (1) when the swingable body (5) is in said orientation extending away from said door, and a rib (301) on the rear portion of the clamp member (1), said rib (301) being clamped, when said body (5) is in said orientation extending away from said door between a tooth-like profiled member (105) and a now overlying member (205) having a tooth-like profile in cross-section, the said tooth-like profiled member (205) being provided on the tapered narrow side of said body (5), and extending therealong in a suitable spaced apart, parallel relation with the said tooth-like profiled member (105), and by the said rib (301) and the said members (105, 205).

3. A device according to claim 1, wherein said body (5) comprises a member (505) having a wing-like profile in cross-section, and being provided between a wheel (7) and a pivot (4) about which the said body (5) is fulcrumed, the said wing-like profiled member (505) being directed upwardly when the said body (5) is in said orientation extending away from said door, said wing-like profiled member (505) being arranged to engage the outward face of the external side of a rail (B3, B4), for causing an upward swinging movement of said body (5), a rounded apex of said body cooperating with the inward face of the said external side of the rail (B3, B4) when the upward swinging movement of body (5) is concluded, said wing-like profiled member (505) abutting against an upper arm of said means for pivotally mounting, and means for holding said body (5) in said operative position.

4. A device according to claim 1, wherein said means for holding said body (5) in its operative position comprises a rib (405) with a convex profile formed on a tapering side of said body (5) and extends parallel to said axis, said rib (405) frictionally and snappingly cooperating with a respective rib (401) provided on the rear end of said means for mounting in parallel relation with the said convex rib (405), and said rib (405) cooperating with a recessed portion (9) formed between the ribs (401, 301) on the rear end of the said means for mounting.

5. A device according to claim 1, wherein said second means for holding said body in said operative position comprises means in said body forming a recess for receiving a rib.

6. A device according to claim 1, for use with two channel-shaped lower rails, and (B3, B4) two of said bodies (5), each of said rails being mounted to said furniture and located at a different respective level, sides of said channels being profiled to facilitate upward swinging movement of each of said body (5) when a slidable door is being assembled.

* * * * *